US007109928B1

(12) United States Patent
Thiele et al.

(10) Patent No.: US 7,109,928 B1
(45) Date of Patent: Sep. 19, 2006

(54) CONFORMAL MICROSTRIP LEAKY WAVE ANTENNA

(75) Inventors: Gary A. Thiele, Dayton, OH (US); Dan S. Janning, Dayton, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 30 days.

(21) Appl. No.: 11/101,662

(22) Filed: Mar. 30, 2005

(51) Int. Cl.
*H01Q 1/38* (2006.01)

(52) U.S. Cl. ..... 343/700 MS

(58) Field of Classification Search ..... 343/700 MS, 343/785, 829, 846, 772
See application file for complete search history.

(56) References Cited

U.S. PATENT DOCUMENTS

| | | | | |
|---|---|---|---|---|
| 4,924,237 | A * | 5/1990 | Honda et al. | 343/702 |
| 6,005,520 | A * | 12/1999 | Nalbandian et al. | 343/700 MS |
| 6,285,325 | B1 * | 9/2001 | Nalbandian et al. | 343/700 MS |
| 6,741,210 | B1 * | 5/2004 | Brachat et al. | 343/700 MS |
| 6,839,030 | B1 * | 1/2005 | Noujeim | 343/700 MS |
| 7,002,517 | B1 * | 2/2006 | Noujeim | 343/700 MS |

OTHER PUBLICATIONS

R.E. Munson, "Conformal Microstrip Antennas and Microstrip Phased Arrays", IEEE Transactions on Antennas and Propagation., Jan. 1974, pp. 74-78, vol. 22.
K.R. Carver et al., "Microstrip Antenna Technology", IEEE Transactions on Antennas and Propagation, Jan. 1981, pp. 2-24, vol. 29, No. 1.
W.L. Stutzman et al., "Antenna Theory and Design", 2nd Edition, 1998, pp. 210-218, John Wiley & Sons, Inc., New York.
D.R. Jackson et al., "Simple Approximate Formulas for Input Resistance, Bandwidth, and Efficiency of a Resonant Restangular Patch Antenna", IEEE Transactions on Antennas and Propagation, Mar. 1991, pp. 407-410, vol. 39, No. 3.
P.R. Haddad et al., "Analysis of Two Aperture-Coupled Cavity-Backed Antennas", IEEE Transactions on Antennas and Propagation, Dec. 1997, pp. 1717-1726, vol. 45, No. 12.
R.C. Hansen et al., "Antennas With Magneto-Dielectrics", Microwave and Opt. Tech. Lett., Jul. 2000, pp. 75-78, vol. 26.
W.L. Stutzman et al., "Antenna Theory and Design", 2nd Ed., 1998, pp. 250-252, Wiley, New York.
W. Menzel, "A New Traveling-Wave Antenna in Microstrip", Archive for Electronics and Communication, German, Apr. 1979, pp. 137-140, vol. 33.
A.A. Oliner et al., "The Nature of the Leakage from Higher Modes on Microstrip Line", IEEE MTT-S Digest, 1986, pp.
A.A. Oliner et al., "Microstrip Leaky Wave Strip Antennas", IEEE MTT-S Digest, Sep. 1986, pp. 443-446.

(Continued)

*Primary Examiner*—Trinh Dinh
*Assistant Examiner*—Huedung Mancuso
(74) *Attorney, Agent, or Firm*—AFMCLO/JAZ; Gerald B. Hollins

(57) ABSTRACT

A microwave radio frequency bidirectional energy flow-capable antenna method and related antenna of the physically conformal microstrip transmission line, traveling wave and leaky wave characterizations; the antenna is especially suited to vehicle mounting. The disclosed antenna operates in an $EH_1$ or other above dominant mode energy wave propagation configuration, a configuration at least partially achieved by an array of selected-location radiating element shortings to an antenna-underlying transmission line ground plane element. Comparisons of the disclosed antenna with characteristics of a similarly classified antenna of somewhat lesser desirable but know characteristics are included.

20 Claims, 13 Drawing Sheets

Dimensions in millimeters

OTHER PUBLICATIONS

W. Menzel et al., "A Microstrip Patch Antenna with Coplanar Feed Line", IEEE Microwave and Guided Wave Letters, Nov. 1991, vol. 1, No. 11.

W. Hong et al., "Broadband Tapered Microstrip Leaky-Wave Antenna", IEEE Transactions on Antennas and Propagation, Aug. 2003, pp. 1922-1928, vol. 51, No. 8.

* cited by examiner

Menzel's Leaky Wave Antenna

Fabricated Menzel's Antenna

CONFORMAL MICROSTRIP LEAKY WAVE ANTENNA

RIGHTS OF THE GOVERNMENT

The invention described herein may be manufactured and used by or for the Government of the United States for all governmental purposes without the payment of any royalty.

BACKGROUND OF THE INVENTION

One of the "Holy Grails" for antenna engineers working in the aircraft and other vehicle fields, where aerodynamic drag and vehicle profile are important, is achieving an antenna with wide bandwidth, high efficiency, a convenient radiation pattern, and a small addition to vehicle profile. This latter characteristic may be considered, with the use of other words, as a need for a vehicle "conformal antenna." The need for these characteristics extends significantly into the world of the stealth aircraft since non-conformal protuberances on an airframe provide a substantial radar signal reflection or return point addition to the aircraft's radar signature. These desired antenna characteristics typically are, however, conflicting in nature and thus an antenna engineer must often make trade-offs amongst these needs.

There are a variety of conformal antennas used in microwave signal and aircraft practice, but perhaps the most studied of these is the microstrip patch antenna. As a result of its relative simplicity with respect to both modeling and construction, the patch antenna has been a subject of extensive research and use for over thirty years. Munson [1] performed seminal work on this antenna as did Carver and Mink [2]. (Numbers of this configuration herein refer to entries in the list of references at the close of this specification.) The simple approximate models developed by these authors have been used since their publication and are now included in the subject matter of many Engineering School undergraduate antenna courses [3].

One of the major challenges associated with the patch antenna is however, the relatively narrow bandwidth such an antenna achieves [4]. Such antennas, if probe or microstrip transmission line fed, have a bandwidth of typically less than 5% and often less than 2% [3]. Increasing the substrate thickness used with these antennas can increase this bandwidth; however, surface waves can be excited in such patch antennas and this leads to a rather serious reduction in efficiency. This reduction can be limited by the introduction of shorting pins, or a cavity that have the effect of squelching surface waves. However, care must be used in achieving such surface wave reductions since placement of metal near the radiating edges of a patch antenna has a significant impact on its properties. Moreover since patch antennas are usually used in large arrays, in part because of their low cost and low gain, shorting pins or cavities cannot always be used due to the proximity of the antenna elements to each other. The result is strong surface wave coupling between adjacent antennas and this complicates the antenna synthesis task. Alternative feeding mechanisms can be used to increase the achieved bandwidth, without exciting surface waves; however, the achievable bandwidth is typically on the order of 20% to 60% [5] but certainly bandwidths of 2:1 or 10:1 are not achievable with any manner of feeding a patch antenna.

Another approach to increasing patch antenna bandwidth, without a commensurate reduction in efficiency involves the use of magneto-dielectric materials [6] in the antenna. However, the relatively high efficiency that can otherwise be achieved with patch antennas requires low loss magnetic materials. Such materials are difficult to realize at high frequencies, at frequencies greater than 1 gigahertz for example.

From another perspective, there are a group of antennas that are inherently of wide bandwidth and have reasonable efficiency. These antennas include printed spirals (including slot spirals), circular log-periodic arrays as well as helix, bicone, and sleeve antennas. A general theory concerning these and other frequency independent antennas has in fact been presented by Rumsey and is described by Thiele [3]. The first two of these wide band antennas are amenable to conformal installation as in an airframe while the latter types typically are protruding antennas. However, like the patch antenna, the radiation pattern for these antennas depends on feed conditions or mode of operation chosen and has a peak normal to the platform in which it is installed. Examples of feed conditions that will result in a pattern peak away from this direction include higher-order mode excitation for the patch or a phase array of elements with the excitation feed phases chosen to steer the beam. However, it is a well-known fact that for a finite array of elements, there are scan limits on the beam for such elements.

The antenna of the present invention provides what is believed to be a useful addition, perhaps even a breath of fresh air, to this antenna selection scene.

SUMMARY OF THE INVENTION

The present invention provides a microwave antenna suited for use as a conformal antenna.

It is therefore an object of the present invention to provide a traveling wave antenna that is based on the use of microstrip transmission line-embodied electrical conductors.

It is another object of the invention to provide an improved leaky wave antenna.

It is another object of the invention to provide physical size improvement for a leaky wave antenna.

It is another object of the invention to provide an improved traveling wave form of a leaky wave antenna.

It is another object of the invention to provide a leaky wave type of traveling wave antenna in which the antenna conductor is a solid and undisturbed conductor having either of two width dimensions.

It is another object of the invention to provide a leaky wave type of traveling wave antenna based upon use of a type of transmission line conductor as the radiating element.

It is another object of the invention to provide a transmission line type of leaky wave traveling wave antenna in which the null effects of certain transmission line perturbations are achieved by alternate and preferable arrangements.

It is another object of the invention to provide an improved leaky wave type of traveling wave antenna.

It is another object of the invention to provide an improved leaky wave type of traveling wave antenna in which the antenna element may have either of two physical width dimensions.

It is another object of the invention to provide a leaky wave type of traveling wave antenna in which the antenna conductor is a solid and undisturbed conductor.

It is another object of the invention to provide an improved leaky wave type of traveling wave antenna having a basic element configuration that may be repeated in a multiple element array.

It is another object of the invention to provide an improved leaky wave type of traveling wave antenna in which the antenna conductor or conductors may be configured in other than straight line shapes.

It is another object of the invention to provide an ultra thin traveling wave antenna.

It is another object of the invention to provide a traveling wave antenna having high efficiency and an end-fire radiation pattern.

It is another object of the invention to provide an antenna making use of a higher order energization and operating mode in a transmission line element.

It is another object of the invention to provide a microwave antenna suited for use as a high performance airframe-mounted conformal antenna.

It is another object of the invention to provide an improved leaky wave type of traveling wave antenna that may be used for both signal receiving and signal transmitting purposes.

It is another object of the invention to provide an improved leaky wave type of traveling wave antenna having a more desirable leakage rate than is achieved by a prior art Menzel antenna.

It is another object of the invention to provide an improved leaky wave type of traveling wave antenna in which omission of active element slots used in a related prior art Menzel antenna precludes existence of slot sourced antenna emissions and hence enables lower emission of undesirable cross polarized radiation components.

It is another object of the invention to provide an improved leaky wave traveling wave antenna in which use of shorting based suppression of fundamental mode energy propagation in a microstrip transmission line element is advantageous over the slot achieved suppression of fundamental mode energy propagation employed in a related prior art Menzel antenna.

It is another object of the invention to provide an improved leaky wave antenna that is easier to feed than previous higher order mode leaky wave antennas.

It is another object of the invention to provide an improved leaky wave traveling wave antenna array in which a reduced degree of mutual coupling between array elements is achieved.

These and other objects of the invention will become apparent as the description of the representative embodiments proceeds.

These and other objects of the invention are achieved by the wideband traveling wave and leaky wave antenna method of communicating microwave radio frequency energy with a vehicle comprising the steps of:

disposing an elongated, electrically insulated outside conductor and ground plane inside conductor, microstrip transmission line antenna assembly in a conforming physical relationship with a selected surface portion of said vehicle;

energizing said elongated metal antenna element outside conductor portion of said microstrip transmission line antenna assembly in an energy radiating higher order operating mode;

suppressing dominant fundamental mode energy propagation along said elongated metal antenna element outside conductor of said microstrip transmission line to achieve an electrical field phase reversal pattern about an orthogonal lengthwise axis of said outside conductor antenna element;

said suppressing step including establishing an electrical field null along said lengthwise axis portion of said elongated antenna element by shorting said lengthwise axis portion of said outside conductor antenna element to said ground plane inside conductor of said microstrip transmission line at a plurality of lengthwise axis locations extending along said elongated outside conductor antenna element in locations wherein said dominant fundamental mode tends to be of greatest amplitude when not suppressed and said energy radiating higher order operating mode tends to be of small amplitude with presence of dominant fundamental mode suppression.

BRIEF DESCRIPTION OF THE DRAWINGS

The accompanying drawings incorporated in and forming a part of the specification, illustrate several aspects of the present invention and together with the description serve to explain the principles of the invention. In the drawings.

DETAILED DESCRIPTION

The antenna of the present invention is an inherently wide bandwidth antenna belonging to the general class of traveling wave antennas. Such traveling wave antennas also include the Beverage-can antenna and the rhombic antenna for examples. Antennas of this type utilize a load element at the end of the antenna to dampen undesirable back energy wave reflections and thus have a limit on their efficiency since the energy dissipated in this load is not radiated. As these antennas become electrically longer however, the main beam of the antenna desirably squints towards the direction of propagation and this characteristic tends to overcome the load energy loss. An enlightening overview of wide bandwidth antennas is disclosed in reference [3] herein; this reference and each of the other references identified in this document are hereby incorporated by reference herein.

The presently desired performance aircraft conformal version of a traveling wave antenna can be implemented using microstrip transmission line technology. The fundamental excitation or operating mode for such a microstrip transmission line of course intentionally does not radiate energy. Such a non-radiating microstrip transmission line arrangement and the related electric and magnetic field patterns are represented in the FIG. 1 drawing herein. The fundamental excitation or operating mode represented in the FIG. 1 drawing is, as is known in the art, achieved by carefully considered microstrip energization and by controlling energy wave propagation characteristics along the antenna element itself. Additional information concerning the latter of these mode-favoring techniques may be appreciated from subsequent discussions herein.

It is also well known in the antenna art that a microstrip transmission line does radiate if it is excited in its first higher order mode with a suppression of the fundamental or dominant mode fields. Hence, it is feasible to realize a traveling wave antenna using microstrip transmission line if the transmission line and its feed components are properly developed for a first or other higher order operating mode. Such an antenna will in principle have wide bandwidth, a near "end-fire" radiation pattern, high efficiency, and be ultra thin in profile (e.g. a profile much less than one quarter of a wavelength). An antenna of this nature does have the drawback of achieving a radiation pattern peak location or direction that is frequency dependent; however, the impact of this property can be minimized for a range of frequencies given sufficient real estate surrounding the antenna elements as is discussed in reference [9] herein. Peaking characteristics may for example be minimized for a range of frequencies if a tapered configuration is used for the antenna [12]. A new lightweight, low cost, easily fabricated, leaky wave configuration for an antenna of these types is the subject of the present invention.

Figure 1:
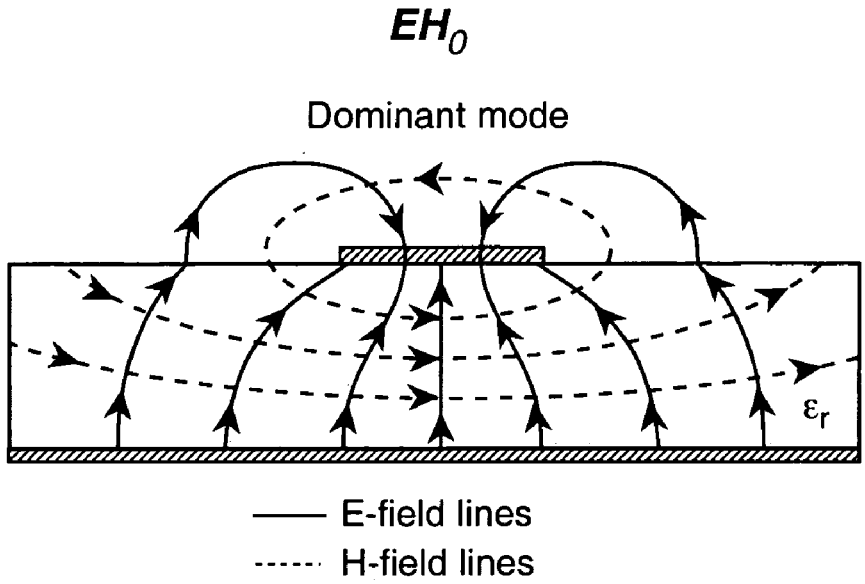
Fig. 1 Prior Art
FIG. 1 shows a non radiating $EH_0$ dominant mode electric field distribution in a microstrip transmission line structure.

A leaky wave antenna is a special form of traveling wave antenna that is characterized by a wave propagating interior to a guiding structure rather than exterior to the structure as occurs for example in the case of the Beverage-can traveling wave antenna. As seen in FIG. 1 herein, the dominant operating mode of a standard microstrip transmission line does not radiate radio frequency energy since the guided wave below the upper microstrip conductor is coherent in nature; or, in other words, the guided wave below the upper microstrip conductor is tightly bound to the structure, there being no phase reversal across the upper microstrip conductor.

Figure 2:
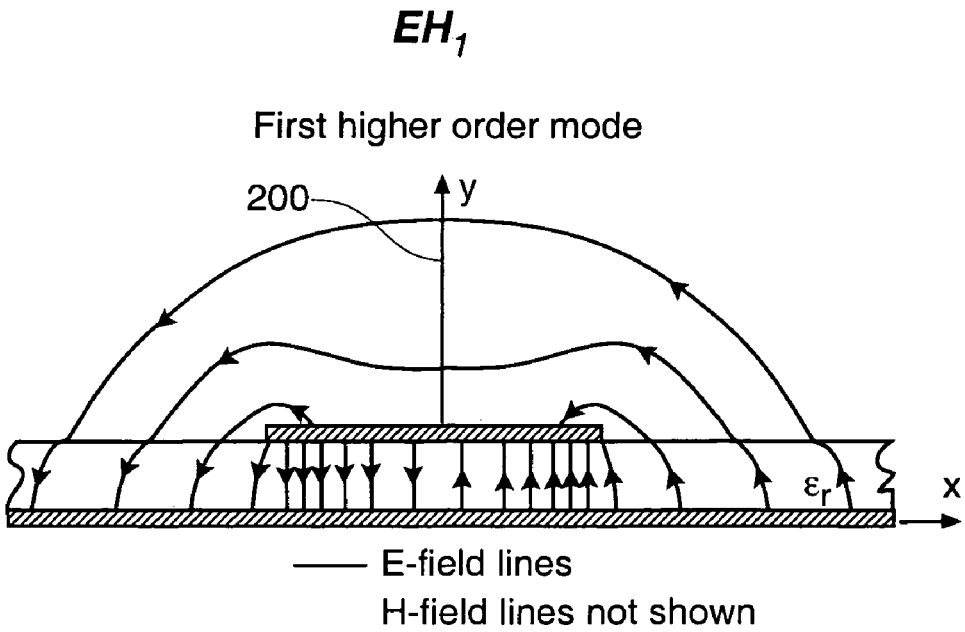
Fig. 2 Prior Art
FIG. 2 shows a radiating $EH_1$ mode electric field distribution in a microstrip transmission line structure.

As shown in the drawing of FIG. 2 herein, when the dominant mode in a standard microstrip transmission line is suppressed, the higher order mode undergoes a phase reversal of the electric field along a centered vertical axis, 200, and radiation of the first higher order mode occurs. Radiation can occur with the electrical field shown in FIG. 2 since the E-field lines at the edges of the upper transmission line conductor are in opposite directions allowing the E-field to add in a direction of radiation whereas in FIG. 1 the E-field lines at the upper conductor edges oppose each other in a direction of radiation.

In the presently desired FIG. 2 related antenna arrangement therefore the guided-wave energy sets up a leaky E field wave exterior to the guiding transmission line structure and thereby "leaks or sheds" power away from the transmission line structure in a controlled manner as the input energy wave propagates from the feed point to the termination point of the transmission line. In doing so, radiation occurs with a peak that squints in the direction of propagation, as is the case with a Beverage-can antenna. In the case of the FIG. 2 antenna however, the transmission line based antenna is amenable to the conformal installation that is desired for high performance aircraft use.

Wolfgang Menzel of Ulm, Germany, proposed in the late 1970's an interesting example of a leaky wave antenna, a specific antenna that is more fully disclosed in reference [8] herein. The Menzel antenna is also shown in the FIG. 3 theoretical version and FIG. 4 fabricated version drawings herein for reference and comparison purposes. The Menzel antenna includes a wide microstrip transmission line having several centerline rectangular slots 300, 302 etc. located close to the feed end of the antenna and in the interior of the transmission line conductor. At microwave frequencies these slots create an electric field null, or a virtual ground, along the center 304 of the microstrip conductor causing this portion of the conductor to effectively short to ground. The FIG. 1 drawing thus shows the relevant field distribution for the center portion of the microstrip conductor of the FIG. 3 and FIG. 4 Menzel antenna. This shorting to ground effect in fact allows the first higher order mode of energy propagation along the length of the Menzel microstrip conductor because an electric field null along the microstrip centerline exists. The FIG. 2 drawing thus shows the relevant $EH_1$ field lines for the Menzel type of antenna appearing in the FIG. 3 and FIG. 4 drawings herein. The FIG. 4 drawing in fact represents an actually fabricated Menzel antenna 400 using microstrip transmission line and having an inches calibrated comparison measuring scale 402 nearby. H field lines are of course also present in the FIG. 2 transmission line but are omitted in the interest of drawing clarity.

Figure 3:
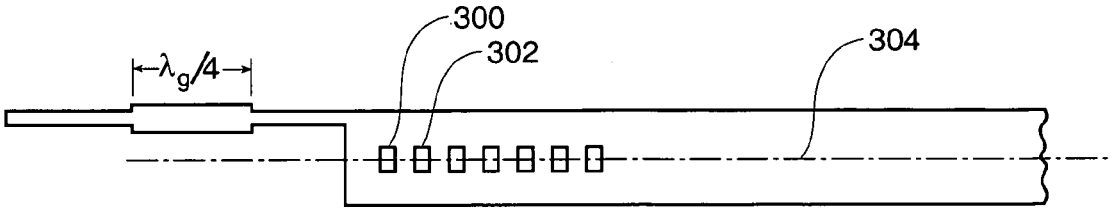
Fig. 3 Prior Art
FIG. 3 shows a theoretical prior art Menzel leaky wave antenna.
Figure 4:
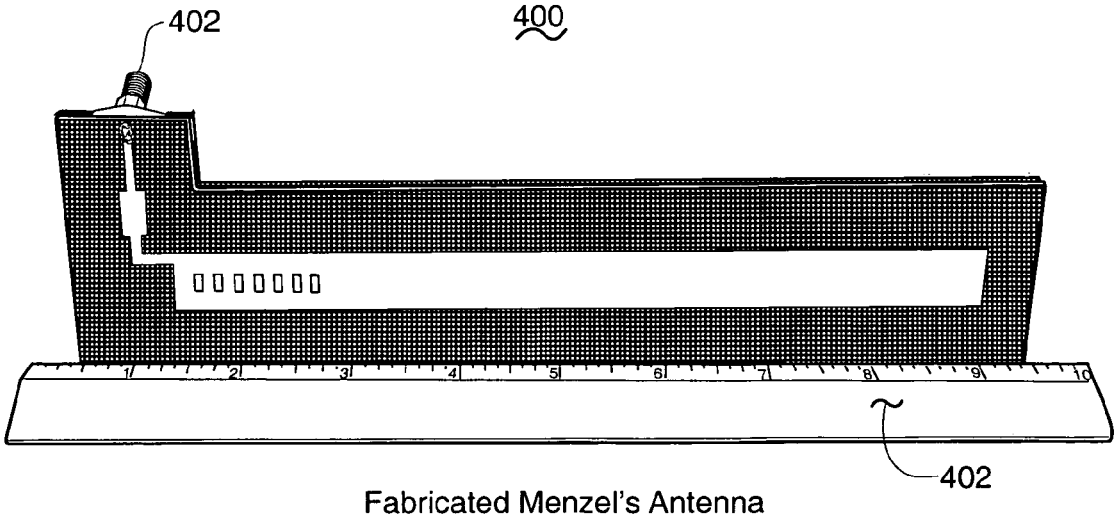
Fig. 4 Prior Art
FIG. 4 shows a fabricated prior art Menzel leaky wave antenna.
Figure 5A:
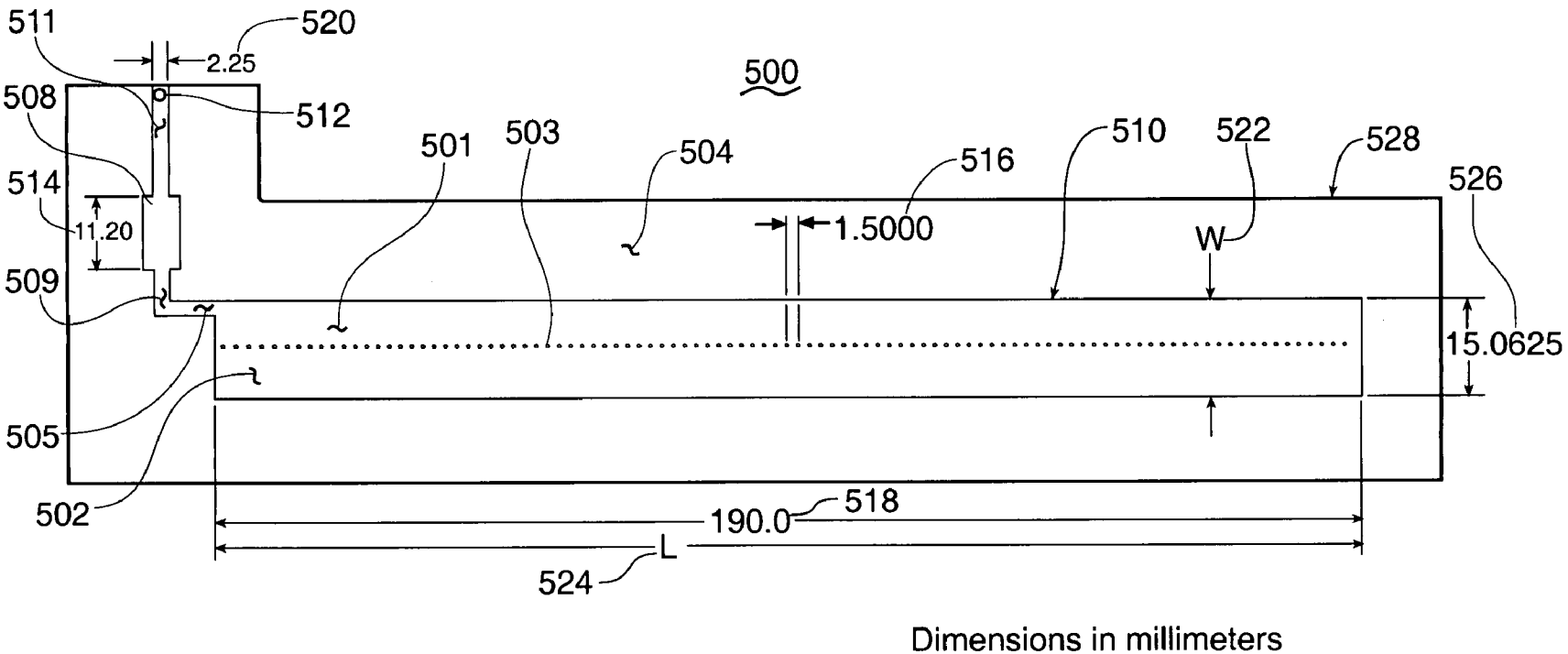
FIG. 5*a* shows details and dimensions for one arrangement of a present invention antenna.

Improvements to the Menzel FIG. 3 and FIG. 4 leaky wave microstrip antenna, improvement according to the present invention, are represented in the FIG. 5 and several subsequent drawings herein. In the FIG. 5*a* drawing portion of FIG. 5 there is shown a microstrip transmission line based antenna 500 inclusive of a first one of these improvements. The antenna 500 includes a body portion or radiating element 510, an input or output electrical energy transmission line segment 511 and a ground plane inclusive electrically insulating substrate member 504. The phrase "input or output" in this sense refers to the fact that the antennas of the present invention may be used in either or both of the transmitting (i.e., electrical signal to electromagnetic wave transducing) or the receiving (i.e., electromagnetic wave to electrical signal transducing) functions even though it is often convenient to speak or think primarily in terms of the transmitting function in describing the invention.

The FIG. 5*a* antenna further includes the two halves 501 and 502 of the radiating element 510 and a row of electrical connections 503, intermediate these two halves 501 and 502, by which the lengthwise extending center portions of the radiating element 510 are multiply connected electrically to a ground plane backside conductor, indicated at 528, of the FIG. 5*a* transmission line. The input or output electrical energy transmission line segment 511 includes an enlarged portion 508 acting as an electrical impedance correction or transformer element at microwave frequencies. The impedance corrected portion of the transmission line 511 connects with one corner of the radiating element 510 as is shown at 505 for energy communicating purposes. A ground plane-side received coaxial cable connector is electrically joined with the transmission line 511 as indicated at 512. The antenna shown in FIG. 5*a* is tuned for operation in about the 6 to 8 Gigahertz range. The illustrated dimensions can be scaled for use at other operating frequencies.

Physical and electrical dimensions for the FIG. 5*a* antenna appear in the FIG. 5*a* drawing. At 520 for example is shown the physical dimensions in millimeters desired for the width of the transmission line conductor 511. Similarly at 516 and 518 in the FIG. 5 drawing are shown the grounding element pitch and the length dimensions for the FIG. 5*a* antenna while the length of the transmission line impedance-changing element is indicated at 514 in FIG. 5. The electrical length and width dimensions for the FIG. 5*a* antenna are indicated at 524 and 522 respectively. It is found desirable for the antenna length dimension, L, at 524 to be between 5 and 10 free space wavelengths for the signal being communicated by the antenna 500. In a similar manner it is found desirable for the antenna width dimension, W, at 522 to be about one third (⅓) of a free space wavelength for the signal being communicated by the antenna. The element identification numbers used in this description of FIG. 5*a* are re used to the best degree possible in the discussions of ensuing drawings herein in order to maintain a consistent identity for an element once assigned. Newly identified elements in these ensuing drawings are assigned an identification number relating to the drawing-number, generally this identification number bears a factor of 100 relationship to the drawing number.

Figure 6:
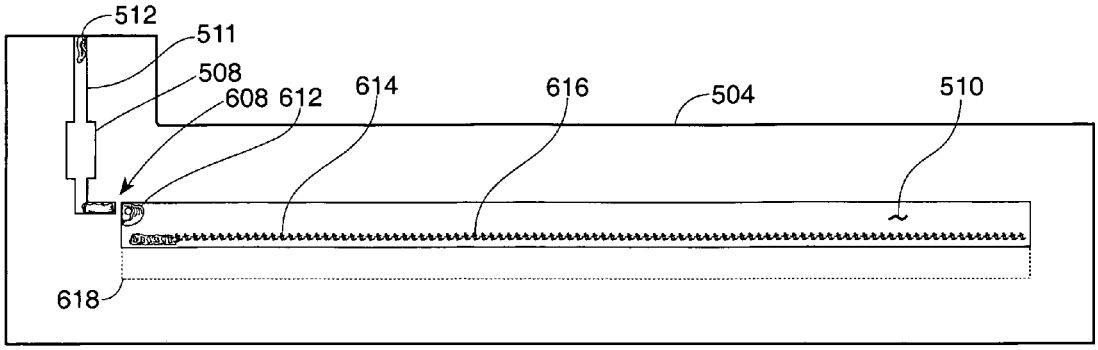
FIG. 6 shows complete antenna front side detail of a present invention leaky wave antenna.
Figure 7:
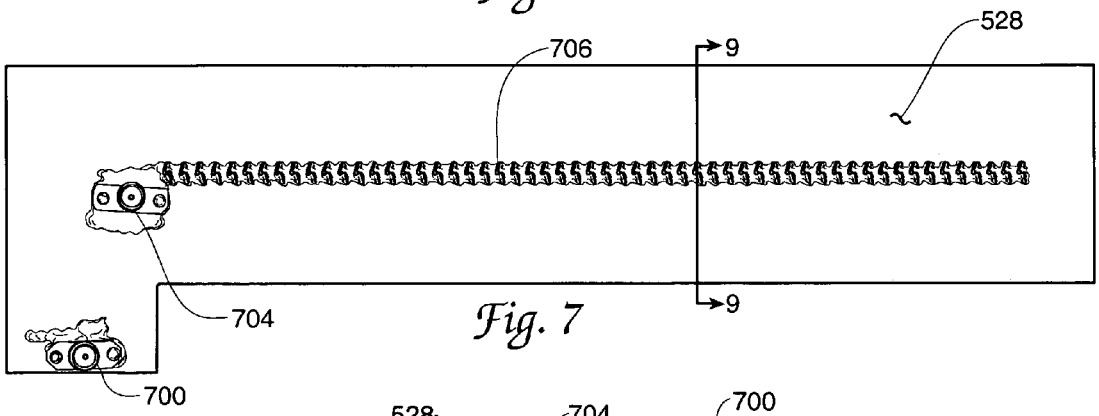
FIG. 7 shows a slightly enlarged backside view of the FIG. 6 antenna.
Figure 8:
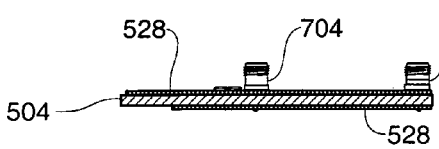
FIG. 8 shows a left hand end view of the FIG. 6 and FIG. 7 antenna.
Figure 9:
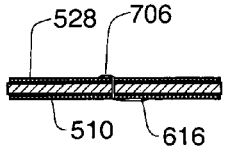
FIG. 9 shows the FIG. 7 defined cross-sectional view of the present invention antenna.

Considering the FIG. 6 drawing in detail, in this drawing there appears a substrate member 504 that may be fabricated as a printed circuit board having transmission line radiating conductor 510 received thereon and having the FIG. 7 shown larger grounded plane transmission line conductor 528 received on the backside thereof. The conductors 510 and 528 may be composed of copper, a copper alloy or of other electrically conductive metals including brass or gold. The substrate 504 in FIG. 6 may be made of a dimensionally stable and high strength material such as Rogers 5870 Duroid PTFE glass fiber or equivalent and may have a thickness of about 0.787 millimeter. This material has a dielectric constant $\square_r$ of 2.33 and is available by way of the current World Wide Web address: rogers-corp. Other characteristics including the leakage constant $\alpha$, propagation constant $\beta$ and characteristic measurements relating to the FIG. 6 antenna appear in subsequent paragraphs herein.

Continuing with describing details of the FIG. 6 and the related drawings of FIG. 7, FIG. 8, FIG. 9, and FIG. 10 herein, the FIG. 6 front side view of an antenna according to the present invention also includes the energy conveying transmission line conductor 511 by which transmitter output energy is coupled to the transmission line radiating conductor 510 or received radiation energy is coupled to a radio receiver apparatus. The enlarged portion of the transmission line conductor 511 at 508 serves the function of an impedance matching element in order to provide a characteristic impedance near 50 ohms at the coaxial cable coupling 700 located on the backside surface of the substrate 504 as shown in FIG. 7; connection of this coupling 700 to the transmission line 511 is represented at 512 in the FIG. 5 and FIG. 6 drawings and may consist of a soldered connection. A second such coaxial cable coupling 704 appears in the FIG. 7 drawing and is attached to the radiating conductor 510 as represented at 612 in FIG. 6. The couplings 700 and 704 appear in profile view in the FIG. 8 right end drawing. The gap 608 in the FIG. 6 view of transmission line conductor 604 allows isolated impedance measuring and other diagnostic measurements of the radiating conductor 510 to be made and is normally absent and replaced with continuation of the conductors 510 and 511 in a completed and serviceable embodiment of the invention, i.e., this gap 608 is normally shorted.

One of the above-described conductor 510 to ground plane 528 shorting element conductors is indicated at 616 in the FIG. 6 drawing and a backside view of this conductor appears at 706 in FIG. 7. As indicated by the cutting line 9—9 in FIG. 7 a cross sectional view of the shorting element conductor 616–706 appears in the enlarged FIG. 9 drawing view. As also suggested in this FIG. 9 view, the illustrated embodiment of the shorting element conductor 616–706 may consist of a copper wire segment folded over into adjacency with each of conductors 510 and 528 and then flow-soldered into place. Other ways of achieving the desired conductor 510 to conductor 528 shorting, including the printed circuit via structure shown in FIG. 16 herein, are of course possible and are considered to be within the scope of the present invention. The number of shorting element conductors 616–706 needed in a particular antenna is dependent on the wavelength of the radio frequency energy being considered and is most conveniently expresses as a number of shorting element conductors per wavelength. It is found, for example, that twenty (20) or more shorting elements per wavelength is a satisfactory arrangement for the invention.

Figure 16:
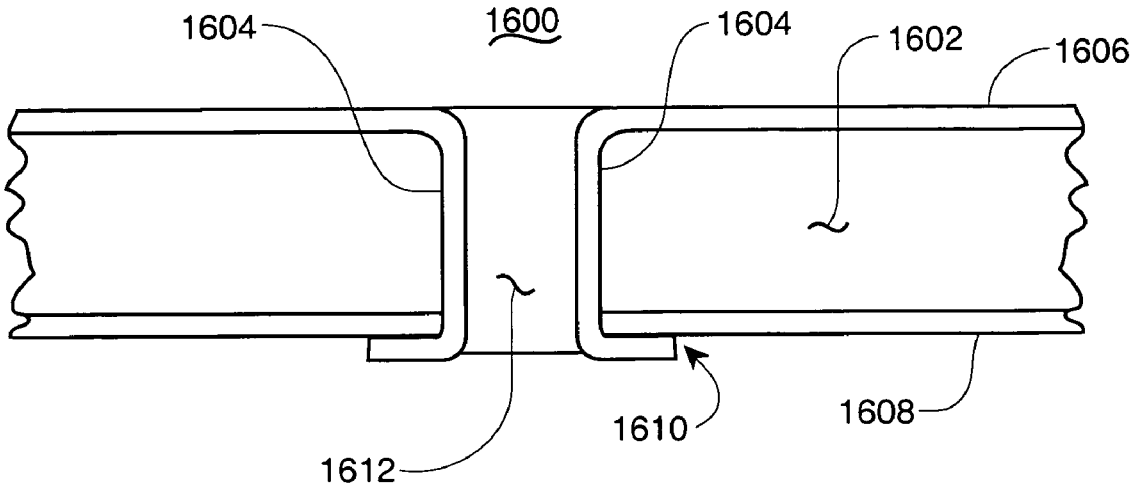
FIG. 16 shows details of a via structure suitable for use with the present invention printed circuit antenna conductors.

While considering the via structure shown in the FIG. 16 drawing it appears appropriate to discuss certain details of this structure as it is usually fabricated in the electrical art. As shown in FIG. 16 the printed circuit board via 1600 is provided with an aperture 1604 of selected size traversing the electrical insulating material 1602 of the printed circuit board. This aperture 1604 additionally passes through the lower surface conductor 1608 of the printed circuit board and is plated through or otherwise filled with upper surface conductor material 1606 including the material at 1610 that overlaps and thereby makes electrical contact with the lower surface material. A similar overlapping arrangement may be used for connection with the upper surface material 1606 if needed. Drilling, masking and equivalent fabrication procedures may be used to achieve the FIG. 16 structure and soldering may be used to improve the electrical contact achieved at 1610. The relatively low electrical impedance and multiple conduction paths achieved by the circular conductor region 1612 in a via is desirable for shorting elements use in the present invention where microwave radio frequencies are involved.

According to the FIG. 5*a* first of the present invention leaky wave microstrip antenna improvements therefore in order to prevent propagation of energy in the $EH_0$ fundamental mode along the antenna microstrip conductor 510, closely spaced, ground plane connected, electrical shorting element conductors are disposed along the center line of the conductor 510. These shorting element conductors may be disposed in the form of the printed circuit board via element shown in the FIG. 16 drawing herein and may also be grounded metal shunts of the type shown at 614 and 616 in the FIG. 6 drawing. These shorting element conductors have an effect comparable to the Menzel rectangular slots 300, 302 in that they achieve an electric field null in the form of an actual elongated conductor multi point grounding along the center of the microstrip conductor 510. The physical null thus accomplished in the electric field attending the FIG. 6 antenna conductor 510 achieves suppression of dominant or $EH_0$ mode propagation in the conductor 510, in the manner represented in the FIG. 1 drawing, and allows propagation of the $EH_1$ mode in the manner shown in FIG. 2. Grounding of the metal shorting elements added for this $EH_0$ to $EH_1$ favoring mode change of course means shorting the upper microstrip conductor 510 to the lower or backplane or remaining microstrip conductor, 528 in FIG. 7, by way of the numerous added metal shorting elements. We now believe this null achievement through use of radiation element shorting to the ground plane is more effective in suppressing fundamental mode propagation than is the slot achieved null generation used in the Menzel antenna. In addition the grounded metal shorting element of the present invention eliminates the need for transmission line slots that have been found to cause undesirable cross polarized radiation by the Menzel antenna.

Figure 5B:
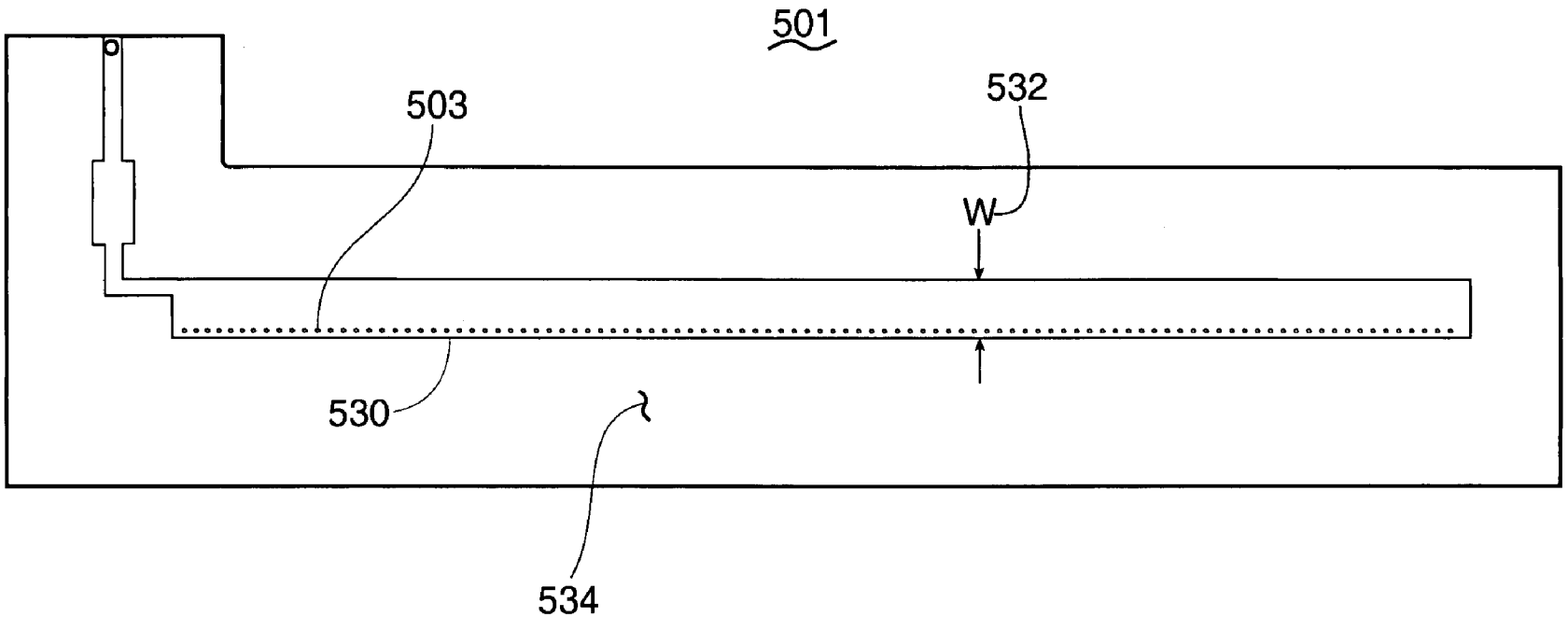
FIG. 5*b* shows details and dimensions for a second arrangement of a present invention antenna.

In addition to achieving the FIG. 2 $EH_1$ field pattern, the desirable effect of grounding the center region of antenna transmission line conductor 510 with shorting element conductors also suggests an ability to dispense with half of the antenna conductor 510, the conductor portion represented by the dotted line 618 in FIG. 6 and the portion represented at 502 in FIG. 5, without detriment to antenna performance. This dispensing is possible because in fact the propagated desired higher order mode has zero amplitude at the location of the vias or shorting conductors whether or not these conductors are present. With this dispensing the resulting antenna element has the appearance shown at 501 in the FIG. 5*b* drawing. The FIG. 5*b* drawing thus shows the second of the microstrip antenna improvements contemplated in the present invention.

In fact the FIG. 5*b* width reduction can be achieved without negatively impacting the suppression of fundamental mode propagation in the narrowed conductor 532. The width dimension of this new transmission line radiating element is shown at 532 in the FIG. 5*b* drawing and is near ⅙ of a wavelength, i.e., one-half of the width dimension on the FIG. 5*a* conductor and the related Menzel conductor. As shown at 530 in the FIG. 5*b* drawing the lower edge of the reduced width conductor is preferably located as close as practical to the FIG. 16 printed circuit vias or the FIG. 9 through conductors accomplishing the front conductor to back plane shorting as is possible. The width of the exposed dielectric surface at 534 in the FIG. 5*b* reduced width antenna is not critical and need only be one half wavelength or more. This new narrow configuration is shown in full conductor length in the fabricated antenna drawing of FIG. 6. Since the footprint of the FIG. 6 antenna is now smaller, an array of such elements for example can be packed closer together with less mutual coupling between elements.

Figure 10:
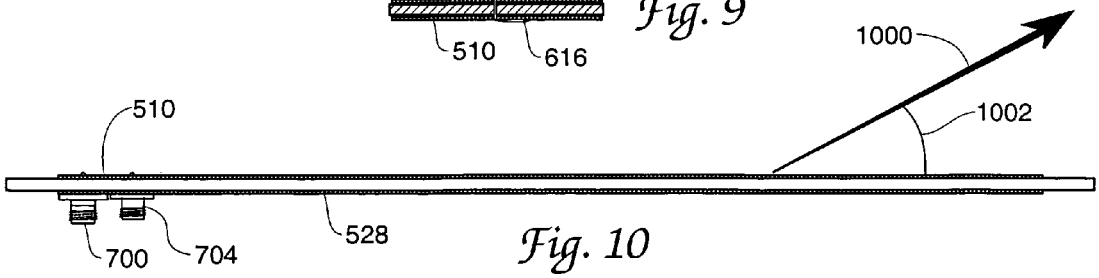
FIG. 10 shows an elevation view and main beam direction for a present invention leaky wave antenna.

FIG. 10 in the drawings shows an elevation view of the antenna in the FIG. 6 through FIG. 9 drawings and shows a somewhat exaggerated form of the metal layers of conductors 510 and 528. Also appearing in FIG. 10 is an arrow 1000 indicating in general the direction of radiation provided by the present invention antenna as a result of EH1 mode propagation between conductors 510 and 528 and radiation leakage from the outside edges of the conductor 510. As suggested previously herein, the angle 1002 between a main lobe of the radiation represented by the arrow 1000 and the antenna conductors 602 and 702 is dependent on the length of the radiating conductor 510 and tends to be smaller in size with a longer radiating conductor. More specific details of this and other characteristics of the present invention antenna appear in the FIG. 11 and subsequent drawings herein. While considering the FIG. 10 drawing however, it is significant to note that use of a sufficient length of the radiating transmission line conductor 510 is usually an adequate condition for enabling the antenna to radiate about ninety percent of the energy received from a transmission line energy source feeding the antenna. Radiation of this large fraction of the input energy of course also means the amount of energy available for undesirable reflections from the radiating end of the antenna is relatively low and in the ten percent of input energy range.

To illustrate performance of the present invention antenna, several measurements comparing a standard Menzel microstrip antenna and the present invention antenna are believed to be informative. A present invention microstrip antenna for measurement and other uses may be created with a state of the art milling machine compatible with the software autoCAD, allowing drawings created in autoCAD to be transferred to accurate tracings of designs etched from copper covered substrate to the accuracy of a tenth of a millimeter. Both the present invention and the Menzel antennas may be fabricated on Rogers 5870 duroid substrate made of PTFE glass fiber with a thickness of 0.787 millimeter. The length of each antenna may be 190 millimeters beginning where the feed transmission line width opens up to the maximum width of the radiating conductor, i.e., beginning at 618 in FIG. 6, and ending at the rightmost end of the antenna conductor. The Menzel antenna width is 15 millimeters while the width of the FIG. 5*b* and FIG. 7 present invention half-width antenna is 7.5 millimeters for a 6.7 Gigahertz version of the antenna.

Figure 11:
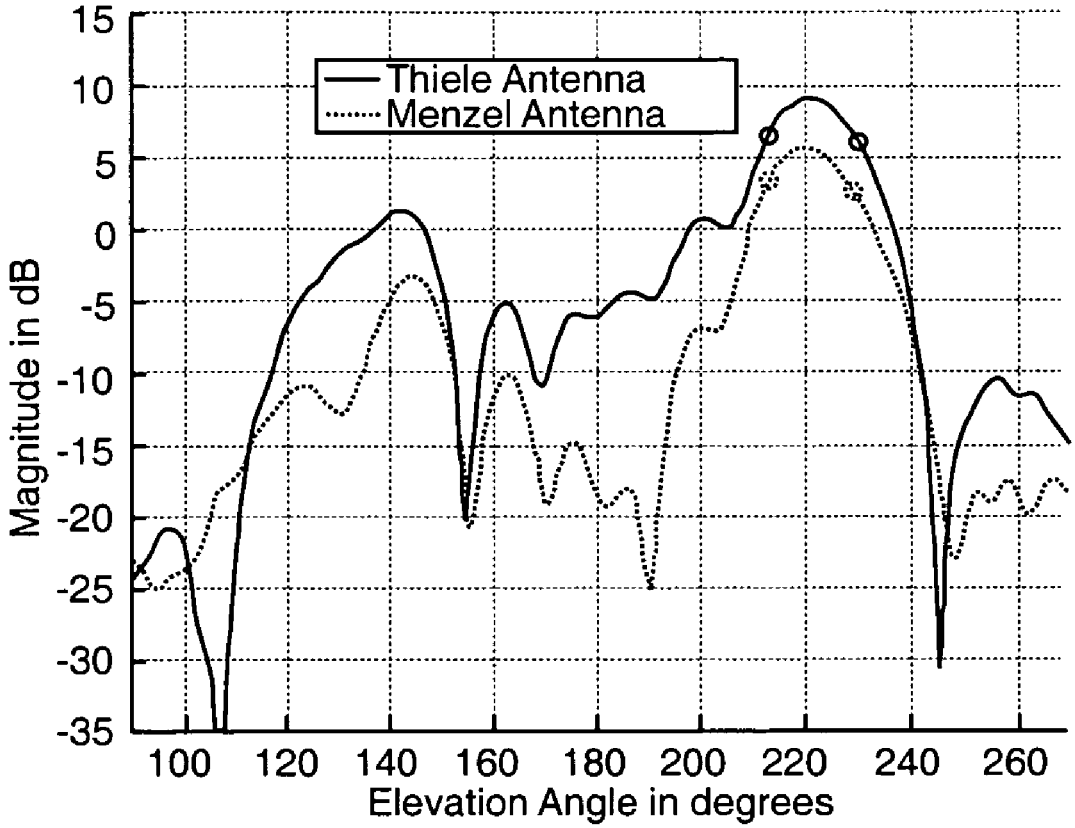
FIG. 11 shows one radiation pattern comparison for a present invention antenna.

FIG. 11 in the drawings shows a comparison of main-lobe elevation field strength pattern measurements i.e., half power beam width field strength versus elevation angle for far-field patterns at 6.7 GHz., made with use of the Menzel antenna and with the present invention FIG. 5*b* antenna in a laboratory setting. These results indicate the present invention antenna notwithstanding its reduced footprint produces radiation pattern similar to that of the Menzel antenna.

For leaky wave antennas, it is also desirable to compare antenna performances by way of considering the leakage constants, $\alpha$, and the phase constants, $\beta$. A leakage constant value relates to the pattern beam width and is significant for minimizing the length of the antenna. The phase constant determines the angular location of the pattern peak. From FIG. 11 it is observed that the HPBW (half-power beam widths) are 16 degrees for the Menzel antenna and 17 degrees for the present invention antenna. This indicates the leakage constant, □, is approximately the same for each antenna. As also seen in FIG. 11, the pattern peak is almost at the same angle for the two antennas; this suggests that the phase constant, $\beta$, is approximately identical for the two antennas.

Figure 12:
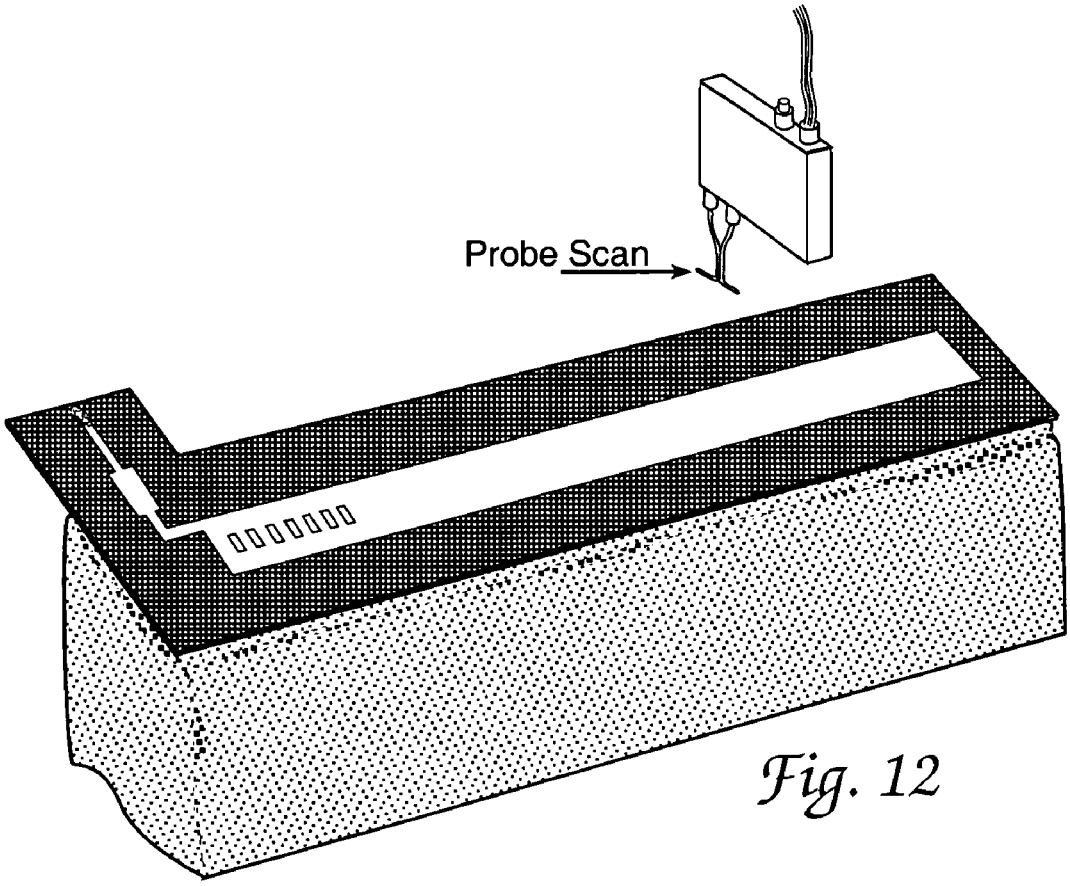
FIG. 12 shows a dipole arrangement for near field measurements of a Menzel or present invention antenna.
Figure 13:
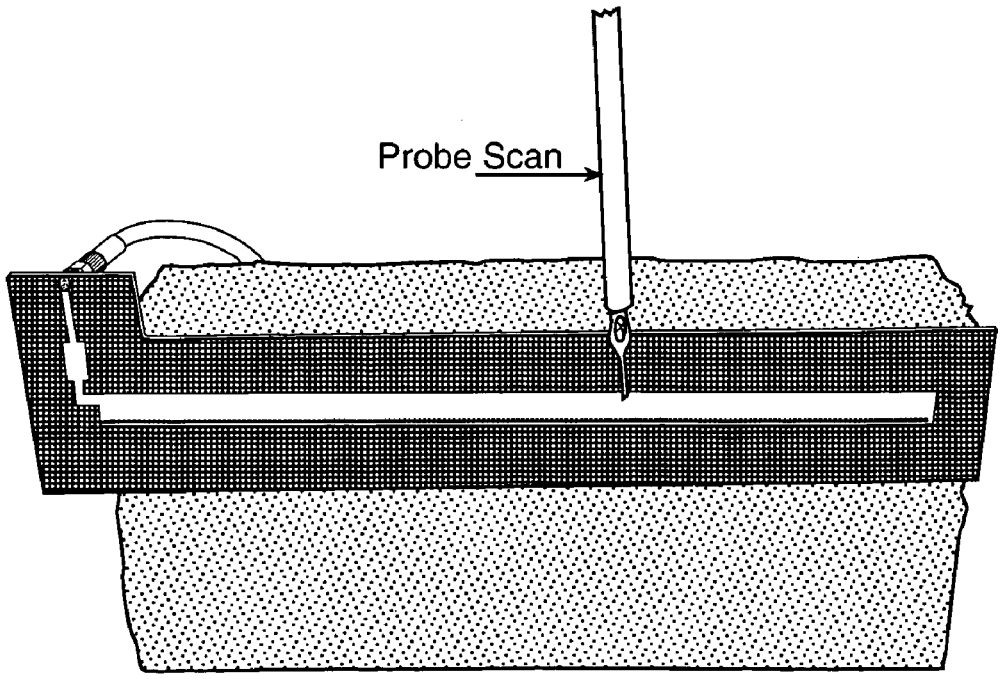
FIG. 13 shows a monopole arrangement for measurements of a present invention antenna.

Since far-field characteristics as in FIG. 11 are but a coarse indicator of the actual source distribution, it is desirable to compare the actual $\alpha$ and $\beta$ for the two antennas. To accomplish this, measurements of the source distribution may be taken by probing the fields near the antenna in a near-field anechoic chamber adapted for this purpose. Two different probe configurations may be used. One configuration is a resonant dipole as represented in FIG. 12 and the other a monopole probe as represented in FIG. 13. Both of these measurements are useful for determining $\beta$, but the results using the dipole are sensitive to dipole height above the tested antenna element making the determination of □difficult. If the test dipole is too close to the antenna, the dipole perturbs the field in an unacceptable manner while the propagating mode requires the probe to be near the antenna. In each probe case, measurements may be taken at increments of one wavelength from one to four wavelengths in total distance. The monopole probe appears most effective in obtaining accurate amplitude distribution results at a distance of greater than 1 wavelength from the antenna under test.

Figure 14:
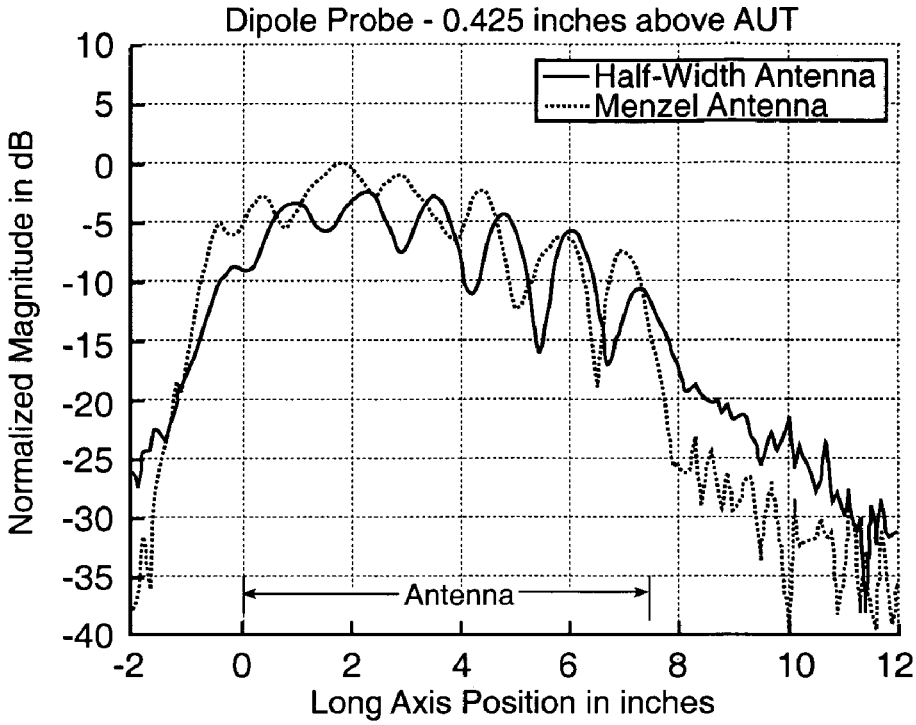
FIG. 14 a comparison of present invention and Menzel antennas accomplished with a FIG. 12 type of measurement apparatus.
Figure 15:
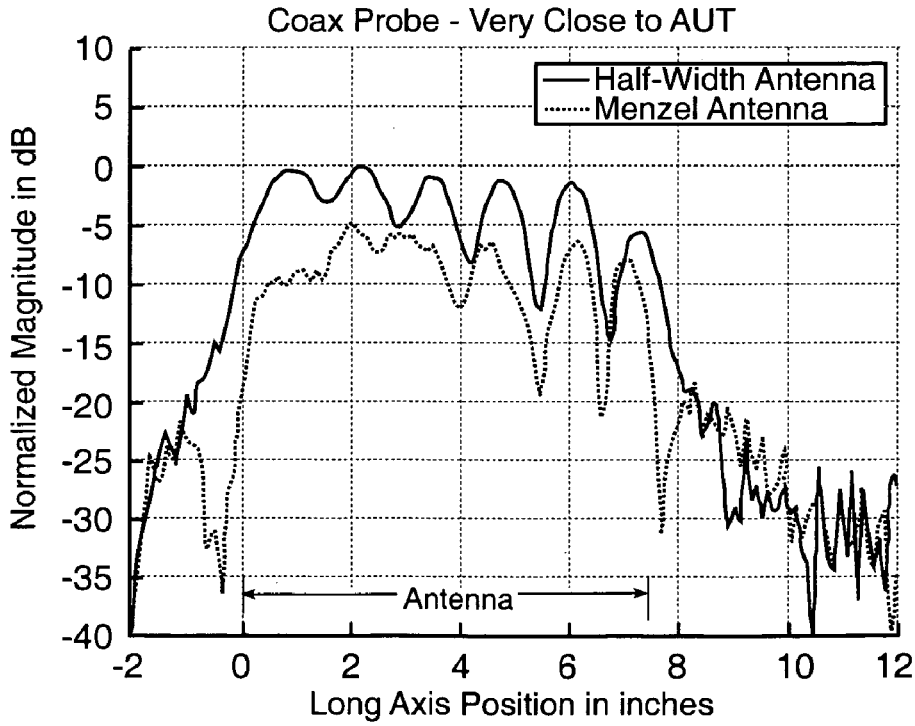
FIG. 15 shows a comparison of present invention and Menzel antennas accomplished with a FIG. 13 type of measurement apparatus.

Results obtained with the two probes are shown in FIGS. 14 and 15 of the drawings for the dipole and monopole probes, respectively. As is evident, in these drawings the electric fields are largest above the antenna itself with attenuation along the propagating axis; however, the fields do not decay to zero. Indeed, the field at the antenna termination is only 20 dB below the peak and there is a non-zero field off the antenna as expected with such a simple antenna configuration. Since the developed antenna field is not fully decayed at the termination, a small standing wave is established (note the ripples in the FIG. 14 and FIG. 15 near-zone fields) and this consequently causes gain fluctuations as a function of frequency. Note further that the present invention antenna near-zone fields are very similar to those of the Menzel antenna.

Figure 17:
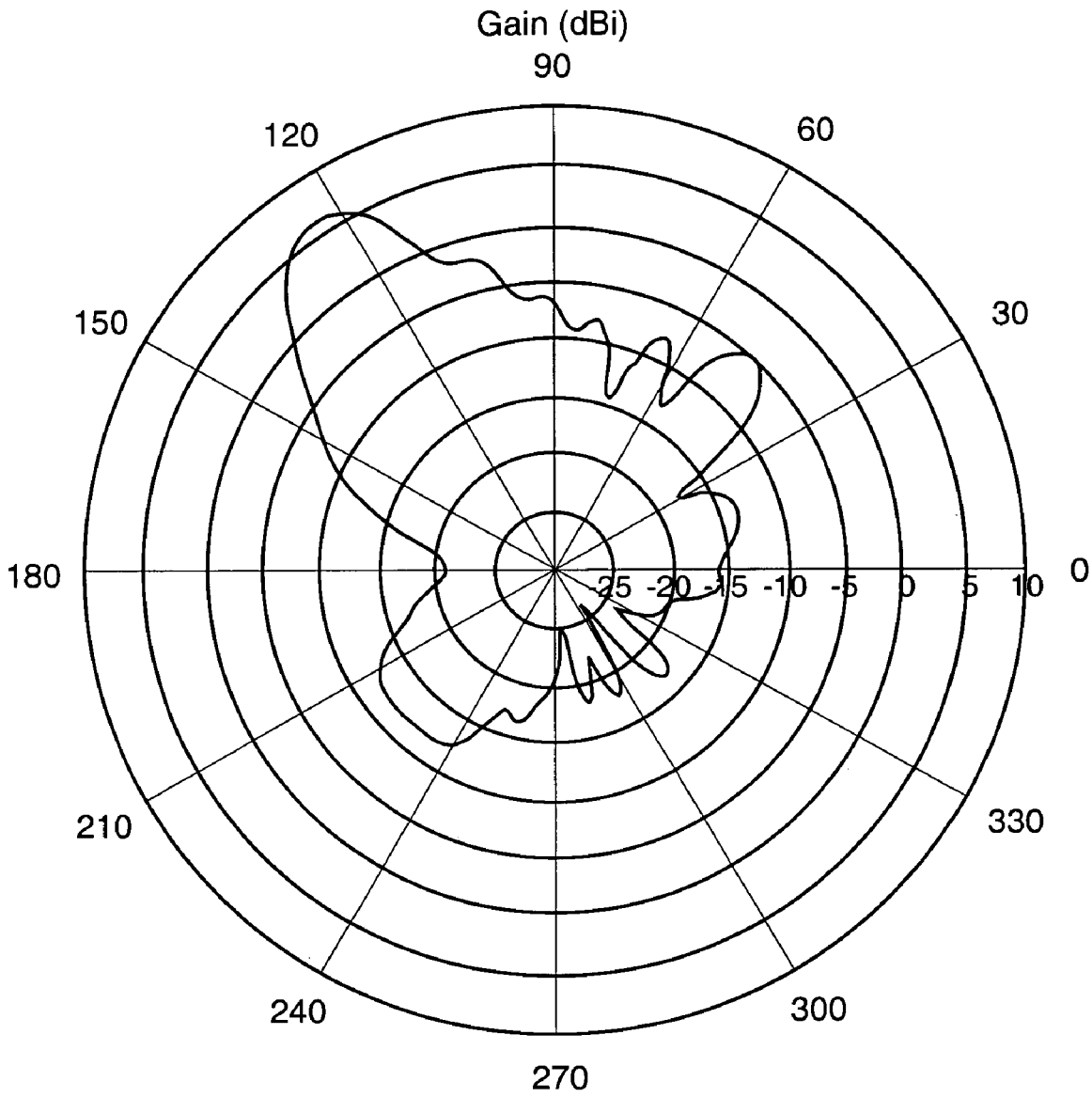
FIG. 17 shows a polar radiation pattern for the FIG. 5*a* antenna.
Figure 18:
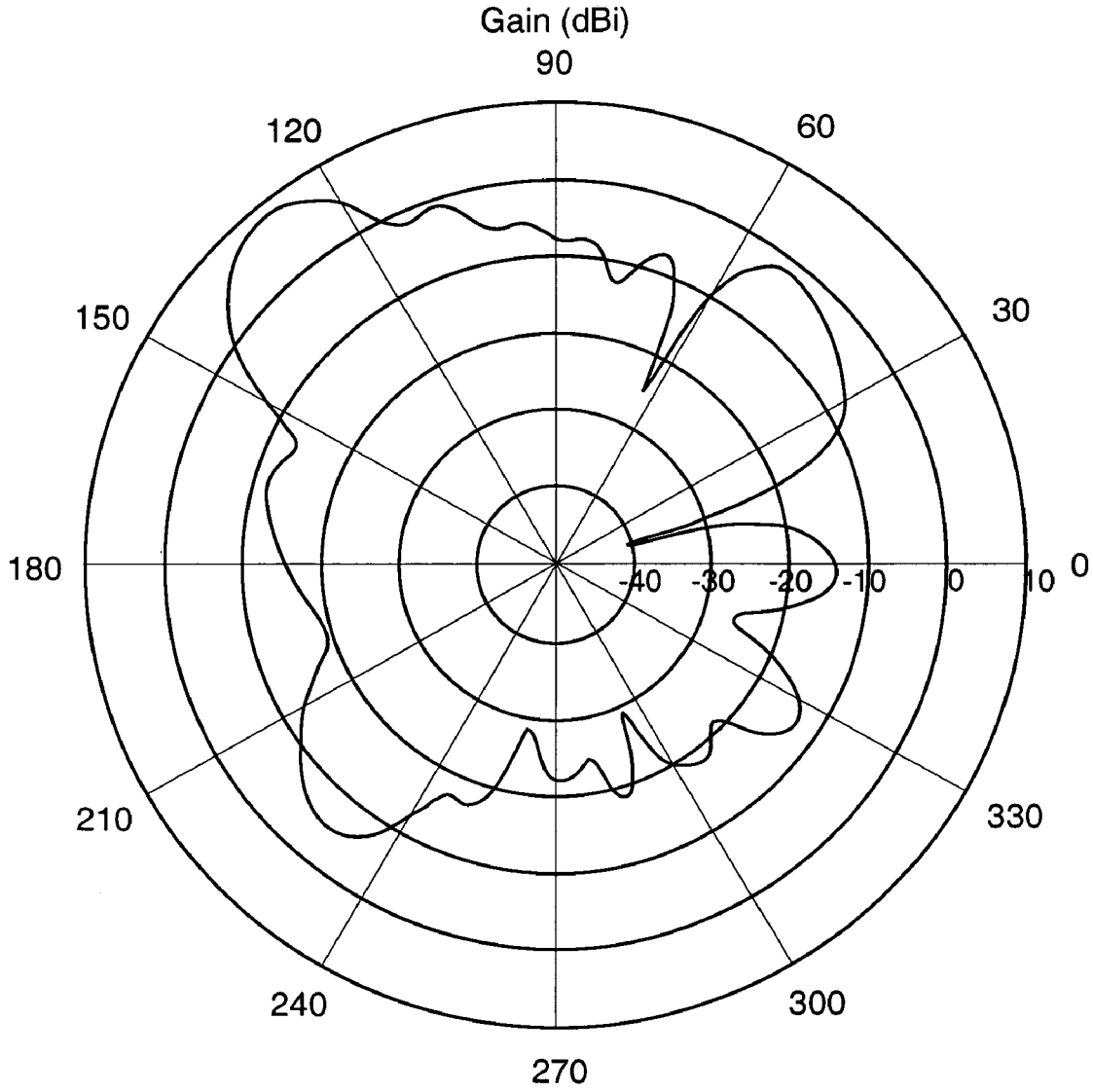
FIG. 18 shows a polar radiation pattern for the FIG. 5*b* antenna.

FIG. 17 in the drawings shows a polar radiation pattern diagram for a FIG. 5*a* version of the present invention antenna, a version having the shorting conductors along path 503 spaced at 1.5 millimeter intervals during 6.7 gigahertz operation. FIG. 18 shows a similar diagram for a FIG. 5*b* antenna. When the FIG. 17 and FIG. 18 drawings are compared, and the scales are adjusted to be the same, it becomes apparent that the FIG. 5*b* antenna has the same beam width as that for the FIG. 5*a* antenna. This indicates the rate of leakage with the metal region 503 in FIG. 5*a* removed is approximately the same as that when this region is present.

Figure 19:
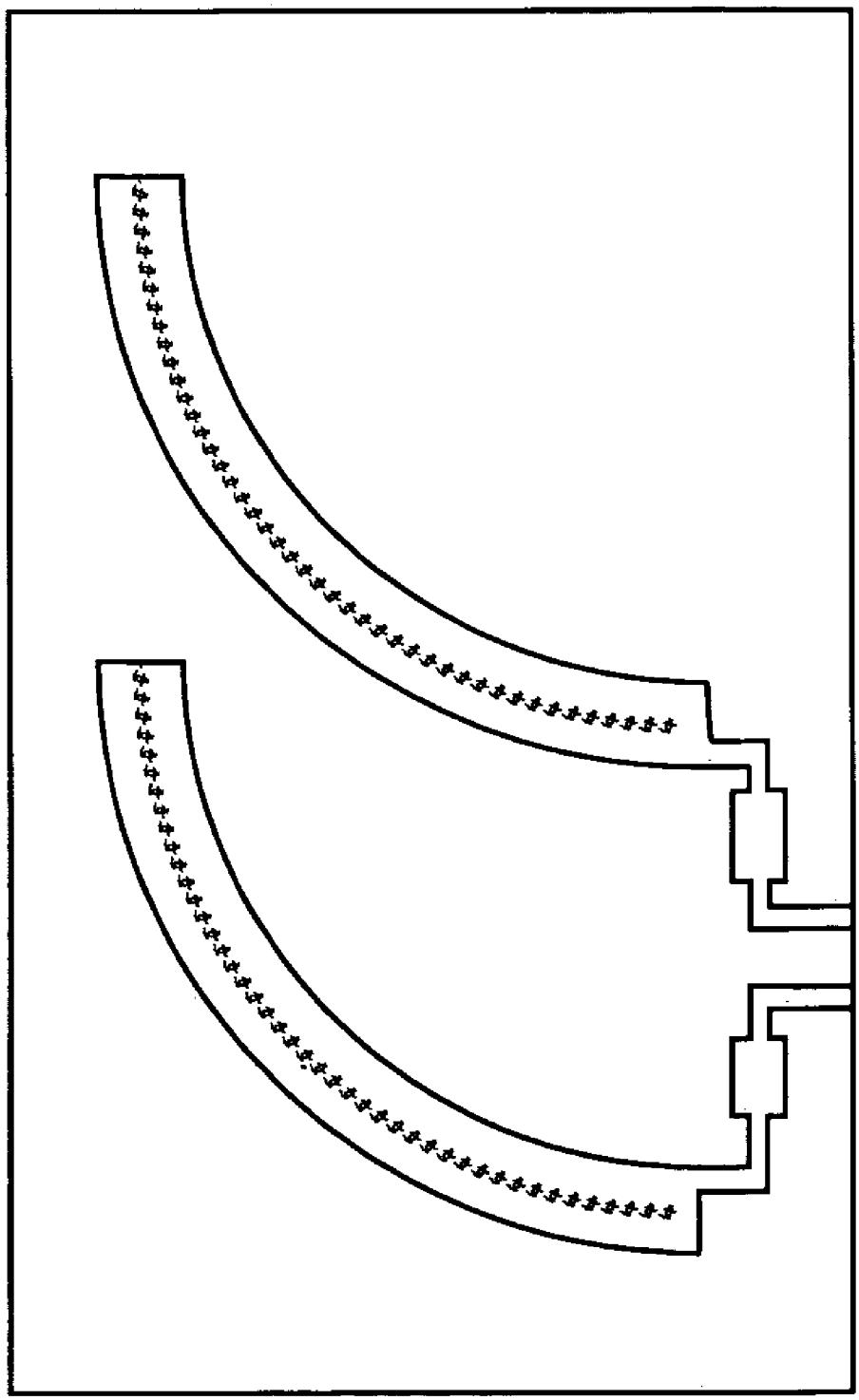
FIG. 19 shows two curved present invention antennas, one fed on the outside radius and the other on the inside radius.
Figure 20:
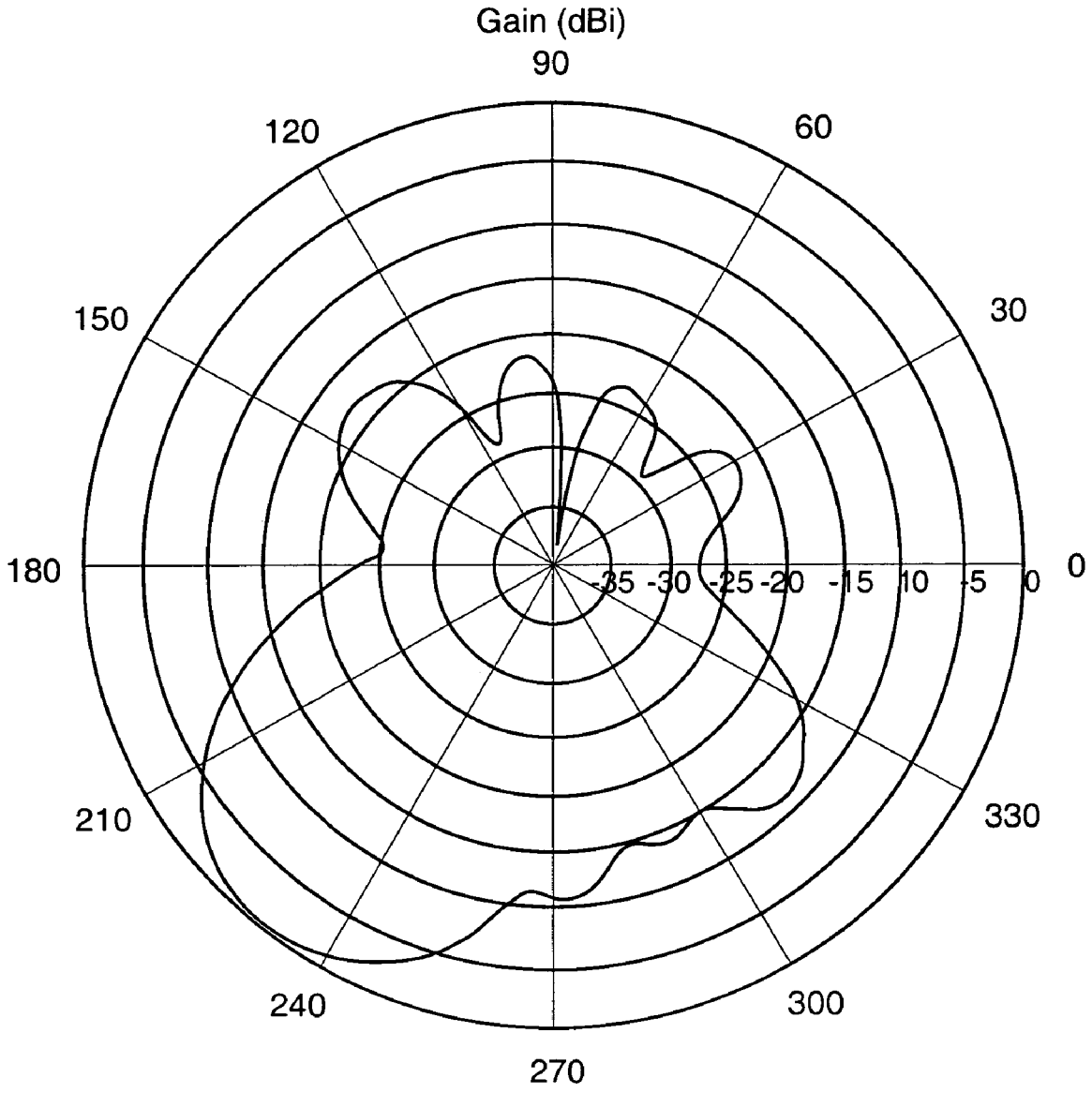
FIG. 20 shows a polar radiation pattern for the FIG. 19 antenna.

FIG. 19 in the drawings shows the combination of two present invention antennas in a curved antenna array. This embodiment of the invention illustrates the fact that straight line arrangements of the antenna are not a requirement of the invention, that antenna cooperation is feasible in a relatively small overall space. The inside radius and outside radius coupling of feeder transmission line elements to the FIG. 19 antennas is worthy of note in the FIG. 19 drawing. A typical radiation pattern for the FIG. 19 antenna is shown in the FIG. 20 drawing. Notably the reduced physical size arrangement of the present invention appears to reduce the degree of mutual coupling between antennas in an array such as that shown in FIG. 19 and in larger arrays.

While the apparatus and method herein described constitute a preferred embodiment of the invention, it is to be understood that the invention is not limited to this precise form of apparatus or method and that changes may be made therein without departing from the scope of the invention, which is defined in the appended claims.

We claim:

1. Leaky wave microstrip microwave radio frequency antenna apparatus comprising the combination of:

a radio frequency energy conveying elongated electrical conductor received on a metal ground conductor backed planar electrical insulating substrate member;

said planar electrical insulating substrate member exceeding said elongated electrical conductor in width by at least one half wavelength of said microwave radio frequency;

an array of electrical shorting element conductors transversely disposed on said planar electrical insulating substrate member along a lengthwise axis of said elongated electrical conductor and connecting said radio frequency energy conveying elongated electrical conductor with said metal ground conductor backing of said planar electrical insulating member at a plurality of periodic intervals along said radio frequency energy emitting elongated electrical conductor; and a microwave electrical energy transmission line element connecting with an energy communication end node of said radio frequency energy conveying elongated electrical conductor and also connected with an antenna energy electrical apparatus.

2. The leaky wave microstrip microwave radio frequency antenna apparatus of claim 1 wherein said energy conveying elongated electrical conductor and said metal ground conductor comprise portions of a microstrip printed circuit board and wherein said array of electrical shorting element conductors comprise one of via element conductors and wired conductors connected with said printed circuit board.

3. The leaky wave microstrip microwave radio frequency antenna apparatus of claim 1 wherein said radio frequency energy conveying elongated electrical conductor has an electrical length of between five and ten wavelengths of said microwave radio frequency energy and has one of an electrical width of one third and one sixth of a wavelength of said microwave radio frequency energy.

4. The leaky wave microstrip microwave radio frequency antenna apparatus of claim 3 wherein said array of electrical shorting element conductors transversely disposed of said planar electrical insulating substrate member along a lengthwise axis of said elongated electrical conductor are disposed in one of a central axis portion of said one third wavelength width elongated electrical conductor and an edge portion of said one sixth wavelength width elongated electrical conductor in an above dominant energy propagating mode null location of said elongated electrical conductor.

5. The leaky wave microstrip microwave radio frequency antenna apparatus of claim 1 wherein said array of electrical shorting element conductors transversely disposed of said planar electrical insulating member is comprised of between twenty shorting conductors per wavelength of said radio frequency energy.

6. The leaky wave microstrip microwave radio frequency antenna apparatus of claim 1 wherein said conductors and said planar electrical insulating member comprise portions of a printed circuit board and wherein said electrical shorting element conductors comprise conductors solder connected with said printed circuit board conductors.

7. The leaky wave microstrip microwave radio frequency antenna apparatus of claim 1 wherein said antenna energy electrical apparatus includes one of a microwave radio frequency source and a microwave wavelength energy sink.

8. The leaky wave microstrip microwave radio frequency antenna apparatus of claim 1 wherein said radio frequency energy conveying elongated electrical conductor is one of a plurality of said conductors disposed in a multiple element antenna array of such conductors.

9. A small footprint, traveling wave, improved, leaky wave, Menzel-related microstrip microwave radio frequency antenna comprising the combination of:

an end fire radiation pattern-generating, Menzel type radio frequency energy conveying elongated metal antenna electrical conductor, comprising a portion of a microstrip transmission line and received on a metal microstrip ground conductor-backed planar electrical insulating member portion of said microstrip transmission line;

said Menzel type radio frequency energy conveying elongated metal antenna electrical conductor including an integral, aperture-free, conductor plan configuration extending along said elongated dimension thereof and having a conductor width dimension of one of one half of and one of a normal Menzel antenna metal electrical conductor;

a plurality of metal conductor post elements disposed along one of an edge-located lengthwise portion of said one half Menzel width elongated metal antenna electrical conductor and a central width location of said one Menzel width elongated metal antenna electrical conductor and orthogonally traversing said electrical insulating member at periodic intervals in repeated interconnection of said elongated metal electrical conductor with said metal microstrip ground conductor and in suppression of $EH_0$ mode energy wave propagation along said elongated metal antenna electrical conductor; and a microwave electrical energy transmission line element connecting with an energy communication end node of said radio frequency energy conveying elongated metal antenna electrical conductor opposite said end fire radiation pattern end thereof and also connected with an external antenna energy electrical apparatus.

10. The small footprint, traveling wave, improved, leaky wave, Menzel-related microstrip microwave radio frequency antenna apparatus of claim 9 wherein said microwave electrical energy transmission line element includes a one-quarter wavelength impedance matching element.

11. The small footprint, traveling wave, improved, leaky wave, Menzel-related microstrip microwave radio frequency antenna apparatus of claim 9 wherein said radio frequency energy is of 6.7 gigahertz frequency and wherein said elongated metal electrical conductor has physical dimensions of seven and one half millimeters wide by at least one hundred eighty millimeters length.

12. The small footprint, traveling wave, improved, leaky wave, Menzel-related microstrip microwave radio frequency antenna apparatus of claim 9 wherein said plurality of metal conductor post elements disposed along said elongated metal electrical conductor and traversing said electrical insulating member at periodic intervals in repeated interconnection of said elongated metal electrical conductor with said metal microstrip ground conductor are at least twenty in number in each wavelength of length of said elongated metal electrical conductor.

13. The small footprint, traveling wave, improved, leaky wave, Menzel-related microstrip microwave radio frequency antenna apparatus of claim 9 wherein said end fire radiation pattern generating, Menzel antenna radio frequency energy conveying elongated metal electrical conductor has a curving trajectory.

14. The small footprint, traveling wave, improved, leaky wave, Menzel-related microstrip microwave radio frequency antenna apparatus of claim 9 wherein said end fire radiation pattern generating, Menzel antenna radio frequency energy conveying elongated metal electrical conductor has an extended overall length dimension enabling leaky wave first higher order mode radiation of at least ninety percent of input microwave radio frequency energy received from said microwave electrical energy transmission line element.

15. The wideband traveling wave and leaky wave antenna method of communicating microwave radio frequency energy with a vehicle comprising the steps of:

disposing an elongated, electrically insulated outside conductor and ground plane inside conductor, microstrip transmission line antenna assembly in a conforming physical relationship with a selected surface portion of said vehicle;

energizing said elongated metal antenna element outside conductor portion of said microstrip transmission line antenna assembly in an energy radiating higher order operating mode; and suppressing dominant fundamental mode energy propagation along said elongated metal antenna element outside conductor of said microstrip transmission line to achieve an electrical field phase reversal pattern about an orthogonal lengthwise axis of said outside conductor antenna element;

said suppressing step including establishing an electrical field null along said lengthwise axis portion of said elongated antenna element by shorting said lengthwise axis portion of said outside conductor antenna element to said ground plane inside conductor of said microstrip transmission line at a plurality of lengthwise axis locations extending along said elongated outside conductor antenna element in locations wherein said dominant fundamental mode tends to be of greatest amplitude when not suppressed and said energy radiating higher order operating mode tends to be of small amplitude with presence of dominant fundamental mode suppression.

16. The wideband traveling wave and leaky wave antenna method of communicating microwave radio frequency energy with a vehicle of claim 15 wherein said locations wherein said dominant fundamental mode tends to be of greatest amplitude when not suppressed are coincident with said orthogonal lengthwise axis of said outside conductor antenna element.

17. The wideband traveling wave and leaky wave antenna method of communicating microwave radio frequency energy with a vehicle of claim 15 further including the step of:

reducing a needed width dimension of said elongated metal antenna element and said stacked conductor microstrip transmission line antenna assembly by omitting a lengthwise extending portion of metal comprising said elongated antenna element, said omitted portion lying on one selected side of said plurality of axis locations extending along said elongated antenna element.

18. The wideband traveling wave and leaky wave antenna method of communicating microwave radio frequency energy with a vehicle of claim 15 wherein said method includes energizing a plurality of said elongated metal antenna element portions connected into an antenna array.

19. The wideband traveling wave and leaky wave antenna method of communicating microwave radio frequency energy with a vehicle of claim 15 wherein said energy radiating higher order operating mode is an $EH_1$ first higher order mode above an $EH_0$ dominant operating mode.

20. The wideband traveling wave and leaky wave antenna method of communicating microwave radio frequency energy with a vehicle of claim 19 wherein said $EH_1$ first higher order mode radiation includes wave propagation interior to said stacked conductor microstrip transmission line of said antenna assembly and achieves radiation of substantially ninety percent of input radio frequency energy before said propagating wave reaches an end terminus of said elongated metal antenna element.

* * * * *